US006547083B2

(12) United States Patent
Zummo

(10) Patent No.: US 6,547,083 B2
(45) Date of Patent: Apr. 15, 2003

(54) POOL CUE HOLDER

(76) Inventor: Connie J. Zummo, CJZ Enterprises, LLC, 4431 Rudetown Rd., Hamburg, NJ (US) 07419

( * ) Notice: Subject to any disclaimer, the term of this patent is extended or adjusted under 35 U.S.C. 154(b) by 0 days.

(21) Appl. No.: 09/990,379

(22) Filed: Nov. 23, 2001

(65) Prior Publication Data

US 2002/0074299 A1 Jun. 20, 2002

Related U.S. Application Data

(60) Provisional application No. 60/255,411, filed on Dec. 15, 2000.

(51) Int. Cl.[7] ..... A47F 7/00

(52) U.S. Cl. ..... 211/68; 211/85.7; 248/346.2; 473/42.43

(58) Field of Search ..... 211/68, 64, 70.2, 211/70.8, 60.1, 85.7, 13.1; 248/346.2; 473/42.43

(56) References Cited

U.S. PATENT DOCUMENTS 1,778,545 A * 10/1930 Allen
4,079,839 A 3/1978 Winfree, Jr.
4,903,929 A 2/1990 Hoffman
4,924,893 A 5/1990 Furey
5,139,221 A * 8/1992 Lodrick ..... 211/68 X
5,169,111 A 12/1992 Dunaj
5,255,799 A 10/1993 Haynes
5,332,185 A * 7/1994 Walker ..... 248/346.2
5,350,147 A * 9/1994 Paganus ..... 248/346.2
5,657,882 A 8/1997 Johnson
D387,114 S * 12/1997 Bliss
5,791,435 A 8/1998 Garnett
5,810,313 A * 9/1998 Armstrong ..... 248/346.2
5,924,662 A 7/1999 Monty
5,954,589 A * 9/1999 Masters ..... 473/42
5,957,291 A 9/1999 Whitfield, Sr.
6,092,675 A 7/2000 Rameriz, Jr. et al.

* cited by examiner

*Primary Examiner*—Robert W. Gibson, Jr.
(74) *Attorney, Agent, or Firm*—Richard C. Litman

(57) ABSTRACT

A portable cue holder comprises a bag having a strap attached at one end. The bag is filled with a discrete material such as lead pellets. The relatively heavy lead pellets will allow the bag to conform to any substantially horizontal surface. The combination of the strap and the relatively heavy lead pellets functions to support the cue in a substantially vertical position.

5 Claims, 2 Drawing Sheets

POOL CUE HOLDER

CROSS-REFERENCE TO RELATED APPLICATION

This application claims the benefit of U.S. Provisional Patent Application Ser. No. 60/255,411, filed Dec. 15, 2000.

BACKGROUND OF THE INVENTION

1. Field of the Invention

The present invention generally relates to support structure. More specifically, the present invention is drawn to a portable device for supporting a pool/billiard cue.

2. Description of the Related Art

It is a common occurrence for pool/billiard players to own their personal cues. These personal cues are expensive, in that they are often custom made with elaborate surface finishes. In billiard parlors and pool halls the usual scenario is for the player to support the cue against some surface when the player is between shots. If not securely supported, the cue may slide and/or roll from the supporting surface and fall to the floor, causing possible damage to the cue and/or marring the finished surface. To prevent such marring and/or damage, it is not at all surprising that a player would desire a portable, easy-to-use device to secure his/her cue in a safe position when the cue is not in use.

In this regard, U.S. Pat. No. 4,079,839 (Winfree, Jr.) shows a holder for supporting multiple cues. However, the holder is designed to be fixedly mounted to a wall.

U.S. Pat. Nos. 4,903,929 (Hoffman), 5,255,799 (Haynes), 5,657,882 (Johnson) and 6,092,675 (Ramirez, Jr. et al.) show portable cue holders all having relatively extensive mechanisms for clamping the holder to a table top or leg.

U.S. Pat. No. 5,924,662 (Monty) discloses a cue support which requires the use of hook and loop fasteners which must be secured to a supporting surface with an adhesive.

U.S. Pat. No. 5,957,291 (Whitfield, Sr.) shows a cue stick holder mounted on a cue stick case. This arrangement limits the area where the cue stick can be supported since the case requires a relative large space.

U.S. Pat. Nos. 4,924,893 (Furey) and 5,169,111 (Dunaj) disclose systems for anchoring shade umbrellas.

U.S. Pat. 5,791,435 (Garnett) shows sandbags for supporting a ladder.

None of the above inventions and patents, taken either singly or in combination, is seen to disclose a portable, easy-to-use cue support device as will subsequently be described and claimed in the instant invention.

SUMMARY OF THE INVENTION

As indicated above, the present invention is a device for supporting a cue in a substantially vertical position when the cue is not in use. The support device is portable and may easily be carried in a cue case or jacket pocket. In use, the device may be positioned on any relatively small, substantially horizontal, planar surface (table edge, chair seat, shelf, etc.). The instant invention is simplistic in design, comprising merely a small bag fabricated from leather or similar material, which bag is filled with small lead pellets. The bag is provided with a strap at one end.

Accordingly, it is a principal object of the invention to provide a device for securely supporting a cue when the cue is not in use.

It is another object of the invention to provide a device for securely supporting a cue, which device is portable.

It is a further object of the invention to provide a device for securely supporting a cue, which device may be disposed on any convenient, substantially horizontal, planar surface.

Still another object of the invention is to provide a device for securely supporting a cue in a substantially vertical orientation.

It is an object of the invention to provide improved elements and arrangements thereof in a device for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
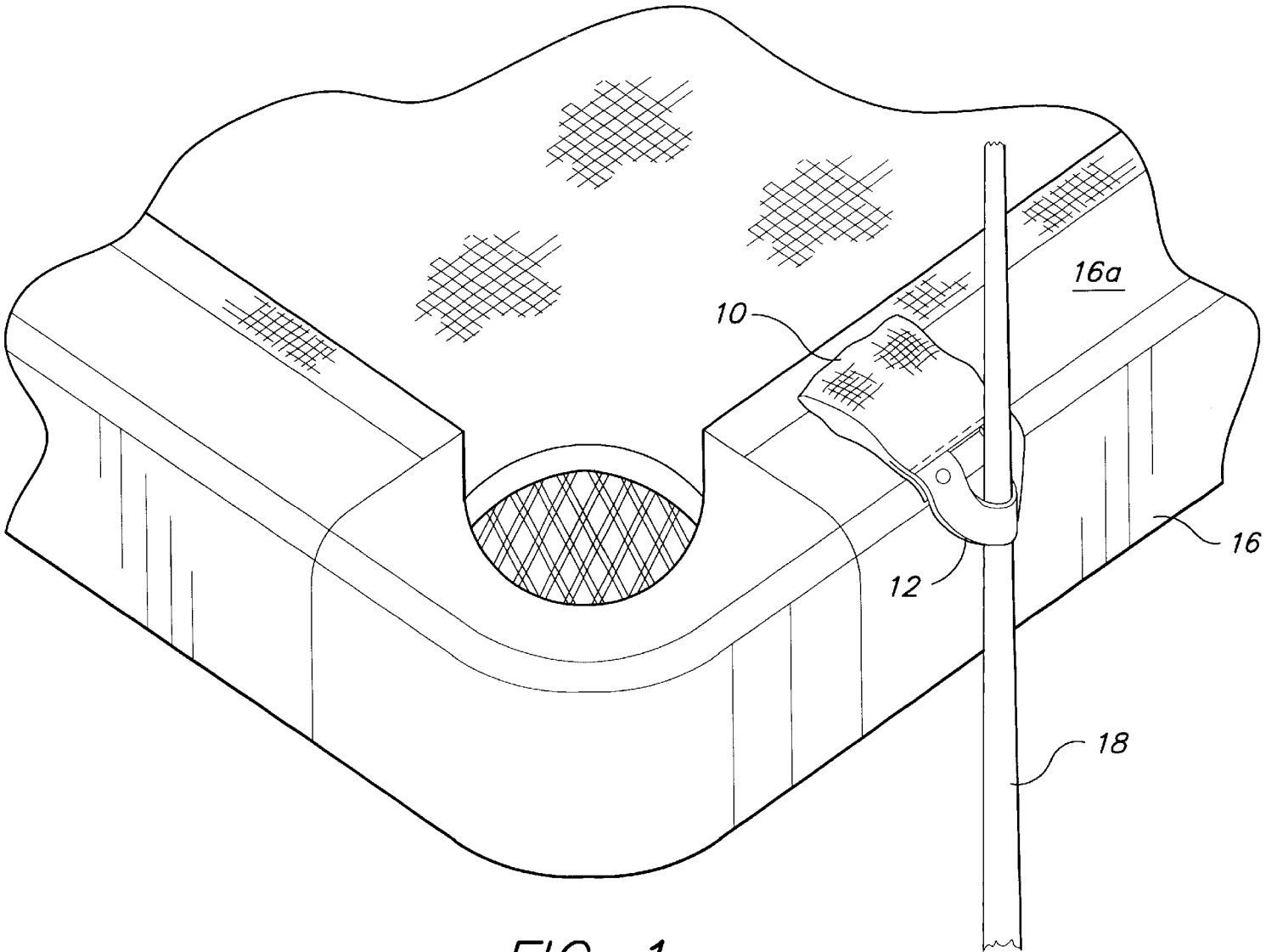
FIG. 1 is an environmental, perspective view of a cue holder according to the present invention.
Figure 2:
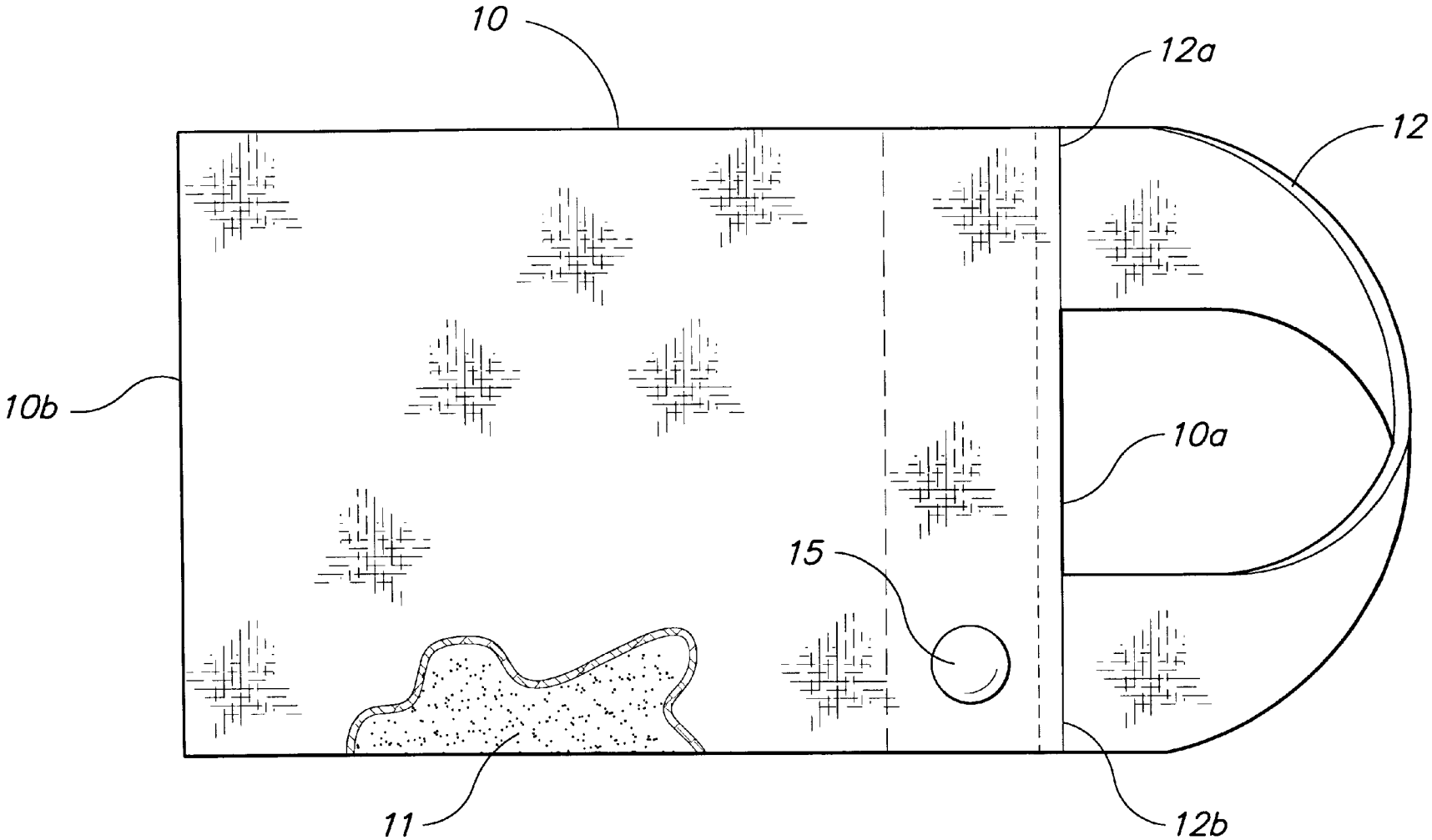
FIG. 2 is a partly-sectioned bottom view of a cue holder according to the present invention.

As illustrated in FIGS. 1 and 2, the present invention comprises a bag 10 having a front end 10*a* and a rear end 10*b*. Bag 10 can be fabricated from any durable, pliable, suitable material such as leather, canvas, vinyl, etc. and its exterior surfaces may be colored and/or decorated with personalized indicia (initials, names, logos, etc.). Bag 10 is filled with lead pellets 11 such that the bag is quasi-moldable and will conform to any surface on which it is disposed. The lead pellets make the bag heavy enough to remain in place when supporting a cue stick 18. Ends 10*a*, 10*b* are sealed by any efficient and convenient means, i.e stitching, to prevent the lead pellets from leaking from the bag. It has been determined that a bag having dimensions of approximately five inches in length and three and one-half inches in width will be adequate for the intended function.

A looped strap 12 is disposed on the front end 10*a* of bag 10 and has ends 12*a*, 12*b* attached at the respective sides of bag 10. To best perform its task, as will be explained below, strap 10 is formed with a radius of curvature of approximately two inches and has a width of approximately one inch. The strap will be provided with a snap fastener 15 on one end.

Using the device of the instant invention is extremely easy. As seen in FIG. 1, the bag 10 is disposed on a planar surface (edge 16*a* of pool table 16). Strap 12 is positioned around and engages cue 18 which will have one end (not shown) in contact with the floor. The weight of the lead pellets in bag 10 will function to maintain bag 10 in its position, thereby maintaining cue 18 in a substantially erect position. It is merely necessary to remove the cue from the confines of the strap when required. Bag 10 may be quickly and easily moved to another location if warranted.

It is to be understood that the present invention is not limited to the sole embodiment described above, but encompasses any and all embodiments within the scope of the following claims.

I claim:

1. A portable holder for supporting a pool cue in a substantially vertical position, comprising:

a substantially rectangular bag having a length, a width, a smooth unobstructed top surface, a smooth unobstructed bottom surface, a closed front end and a closed rear end defining a sealed volume;

a discrete pelletized material enclosed within the sealed volume of said bag;

a strap having a first end secured to the front end proximate a first corner of said bag and a second end having a snap fastener disposed thereon for removably attaching the second end to the front end proximate a second corner of said bag, whereby said strap forms a loop having a radius of curvature of approximately two inches when the second end is attached to the bag.

2. A portable cue holder as recited in claim 1, wherein said bag and said strap are fabricated from a pliable material.

3. A portable cue holder as recited in claim 1, wherein said discreet pelletized material is lead pellets.

4. A portable cue holder as recited in claim 1, wherein said width of said bag is approximately three and one-half inches.

5. A portable cue holder as recited in claim 4, wherein said length of said bag is approximately five inches.

* * * * *